United States Patent [19]

Jawniszko

[11] 4,004,215

[45] Jan. 18, 1977

[54] ALTERNATING CURRENT VOLTAGE REGULATOR INCLUDING SATURABLE INDUCTOR AND MEANS TO BLOCK THE CURRENT FLOW THERETHROUGH

[75] Inventor: Ludomir Jawniszko, Warsaw, Poland

[73] Assignee: Zaklad Aparatury Laboratoryjno-Medycznej Zalmed, Warsaw, Poland

[22] Filed: Apr. 5, 1974

[21] Appl. No.: 458,128

Related U.S. Application Data

[63] Continuation-in-part of Ser. No. 350,105, April 11, 1973, abandoned.

[30] Foreign Application Priority Data

Dec. 4, 1972 Poland ..... 154692

[52] U.S. Cl. ..... 323/56; 323/45; 323/89 B

[51] Int. Cl.[2] ..... G05F 1/04

[58] Field of Search ..... 323/6, 56, 57, 58, 45, 323/89 R, 89 B, 75 N; 321/25

[56] References Cited

UNITED STATES PATENTS

| | | | |
|---|---|---|---|
| 2,714,188 | 7/1955 | Scherer | 323/6 |
| 3,056,078 | 9/1962 | Goodier et al. | 323/89 R |
| 3,154,947 | 11/1964 | Poshadel et al. | 323/75 N |
| 3,209,239 | 9/1965 | D'Agostino | 323/45 |

FOREIGN PATENTS OR APPLICATIONS

| | | | |
|---|---|---|---|
| 1,233,474 | 2/1967 | Germany | 323/56 |

*Primary Examiner*—Gerald Goldberg
*Attorney, Agent, or Firm*—Eric P. Schellin; H. Karl Saalbach

[57] ABSTRACT

The invention relates to a voltage regulator for alternating current using a saturable core inductor as a control element for the voltage at the output of the regulator. Each half wave of the output voltage of the regulator is compared with a reference voltage by way of an unfiltered full wave rectifier. An unbalanced bridge having a temperature variable resistor such as an incandescent lamp, in one arm thereof is positioned to receive the pulses produced by the rectifier. At the instant that the pulse wave at the output of the bridge exceeds the reference voltage, the current through the control winding of the saturable core reactor is suddenly blocked. The blockage continues until the pulse becomes less than the reference voltage. This blockage so reacts on an auto-transformer in series with the supplied alternating current as to cause the output alternating current voltage to be reduced. The blockage or interruption causes the change in alternating current voltage to take place very quickly. The use of the bridge having the temperature variable resistor in one arm thereof permits intermediate control, yet increases larger pulse waves to a greater extent than small pulse waves.

11 Claims, 7 Drawing Figures

ALTERNATING CURRENT VOLTAGE REGULATOR INCLUDING SATURABLE INDUCTOR AND MEANS TO BLOCK THE CURRENT FLOW THERETHROUGH

CROSS-REFERENCE TO RELATED APPLICATIONS

This application is a continuation-in-part of application, Ser. No. 350,105, filed Apr. 11, 1973, by Ludomir Jawniszko, now abandoned.

BACKGROUND OF THE INVENTION

This invention relates to voltage regulators for alternating current, such as powerline voltage stabilizers, which include a transductor comprising a saturable core and having a control or magnetizing winding and a main winding, the main winding being connected to control the output voltage of the regulator.

In known such voltage regulators, the magnetizing current in the control winding is varied continuously in accordance with variation of the output voltage, generally by means of a direct current amplifier. A disadvantage of such known regulators is that due to the large amount of inductance of the control winding, there is a substantial delay between the variation in the output voltage and the correction thereof. Due to this large inductance, the change in current flow in the control winding follows the variation in output voltage after a delay. In many such known voltage regulators, the consequent delay in correction of output voltage, which is known as "reaction time," may be as much as 150 msec. The long reaction time of known voltage regulators causes essential operational difficulties to arise when they are used to graduate deflection devices or galvanometers, or to feed computers or other devices requiring a more stable feed voltage. While it is known that including a resistor in series with the magnetizing circuit will decrease the reaction time to a certain extent, increasing this resistance also requires increasing the voltage and power of the magnetizing circuit. Such an increase in magnetizing power is uneconomical, in fact, if the series resistor is greatly increased, the power of the magnetizing circuit may be greater than the power to be stabilized.

SUMMARY OF THE INVENTION

It is an object of this invention to provide an improved alternating current voltage stabilizer.

It is a further object of this invention to provide an improved alternating current voltage stabilizer that requires a minimum of stabilizing power.

It is a still further object of this invention to provide an improved alternating current voltage stabilizer having a short reaction time.

In accordance with this invention, these objects have been attained by providing means to interrupt or block the magnetization current flowing through the control winding of the transductor when the instantaneous vale of a control voltage, which is a measure of the output voltage of the regulator, exceeds a definite value provided by a reference voltage. This interruption of the magnetizing current causes a high overvoltage to be produced in the magnetizing or control circuit of the transductor, and thereby the output voltage of the regulator is changed towards the desired value. A full wave rectifier without filtering is used to change a control portion of the output voltage into unidirectional pulses, so that the instantaneous value of both the positive and the negative excursion of the output wave may control the interruption of the magnetizing current. The interruption of the magnetizing current takes place very quickly as soon as the voltage of a pulse reaches the voltage of the reference source, and the interruption lasts until the voltage of the pulse becomes less than the reference voltage.

Further in accordance with this invention, an unbalance resistive bridge is connected between the rectifier and the magnetizing current interrupting means. One arm of the bridge includes a temperature responsive resistor, such as an incandescent lamp. Since the bridge is unbalanced, and contains no reactance, unidirectional pulses appear at the output of the bridge instantaneously, the amplitude of the pulses depending on the degree of unbalance of the bridge. If a large amplitude signal is applied to the bridge, the temperature variable resistor is heated up, whereby its resistance varies, and the unbalance of the bridge increases and the amplitude of the output pulses is amplified, in effect, more for larger input pulses to the bridge than for small input pulses, whereby the output voltage is stabilized quickly and the reaction time is reduced, even for a large undesired change in output voltage. The reactance in the circuit between the input to the full wave rectifier and the control winding is minimized to still further reduce reaction time of the regulator.

BRIEF DESCRIPTION OF THE DRAWING

The invention will be better understood upon reading the following description in connection with the accompanying drawing in which.

DESCRIPTION OF THE PREFERRED EMBODIMENT

Figure 1:
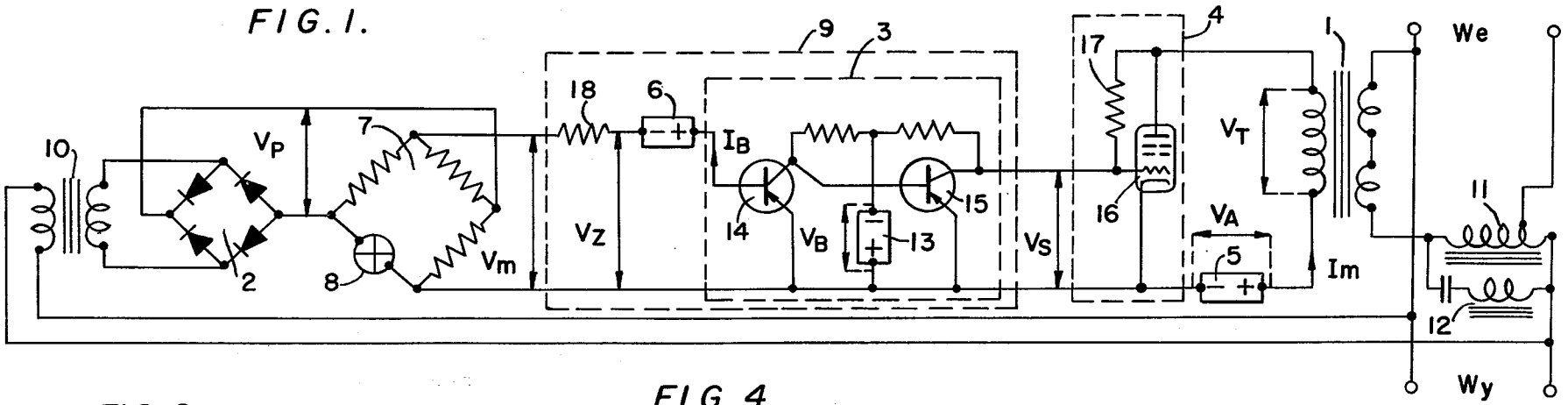
FIG. 1 is a circuit diagram of a preferred embodiment of this invention.

Turning first to FIG. 1, the input voltage, which may vary is applied between the terminals W*e*, and the output voltage, which is regulated, is taken from between the terminals W*y*. One terminal W*e* is connected directly to one terminal W*y*. The other W*e* terminal is connected to the other W*y* terminal through a portion of an iron core auto-transformer 11. The main winding of a transductor 1 is connected between the first mentioned W*e* terminal and the last mentioned W*y* terminal by way of the auto-transformer 11. A harmonic filter 12, which reduces the amount of undesired harmonics at the output terminals W*y*, is connected across the auto-transformer 11.

Figure 2:
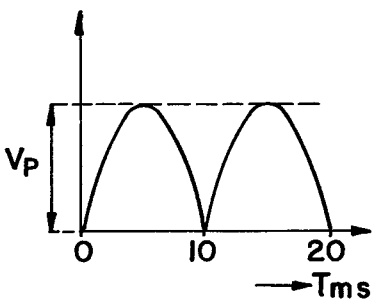
FIGS. 2–7 are curves that are useful in explaining the operation of the circuit of FIG. 1.

The primary winding of a control transformer 10 is connected across the output terminals W*y*. The secondary winding of the control transformer 10 is connected across the diagonals of a rectifying bridge 2. Therefore, the voltage V*p*, see FIGS. 1 and 2, appearing across the other diagonals of the rectifying bridge 2, is proportional to the output voltage across the terminals W*y*. Since no filtering is included in the circuit, each half wave of the alternating current appears as unidirectional pulses or of sine wave shape.

The output diagonals of the rectifier bridge 2 are connected to input diagonals of a resistance bridge 7, whereby the voltage V*p* is applied to the bridge 7. One arm of the bridge 7 includes a temperature variable resistor 8, such for example as an incandescent lamp.

Figure 3:
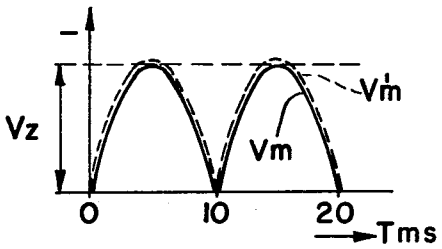

The bridge 7 is normally unbalanced whereby a voltage $Vm$, see FIGS. 1 and 3, appears at the other diagonals of the bridge 7. Since there is no reactance in the bridge 7, it produces no delay. The application of pulses $Vp$ to the bridge 7 heats the resistor 8 and changes its resistance in proportion to the amplitude of the pulses $Vp$, further unbalancing the bridge 7. Since the unbalance of the bridge is greater for greater pulses $Vp$, which are themselves a measure of the amplitude of the output voltage at the terminals $Wy$, the bridge in effect amplifies pulses $Vp$ which are the result of large increases in output voltage more than small pulses $Vp$ which are due to small increases in voltage at the output terminals $Wy$. Therefore, the speed of correction of the voltage of higher voltages at the output terminals $Wy$ is increased.

The voltage $Vm$ appearing at the output terminals of the bridge 7 is applied to a discriminator 9 which includes a resistor 18 and a source 6 of reference voltage $Vz$, see FIGS. 1 and 3. The voltage of the source 6 and the pulses $Vm$ are of opposite polarities, whereby only when the pulses $Vm$ are of greater voltage than the reference source 6 is any voltage applied to comparison system 3 included in the discriminator 9. In FIG. 3, $V'm$ indicates an increased $Vm$ as will be further explained.

Figure 4:
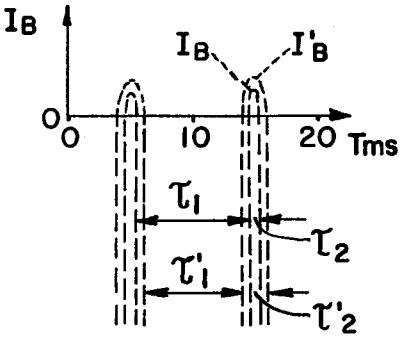

The comparison system 3 includes two PNP transistors 14 and 15. The emitters of the transistors 14 and 15 are connected together and comprise an input terminal of the comparison system 3. As shown this terminal of the comparison system 3 is connected to an output diagonal of the bridge 7. The base of the transistor 14, which constitutes another input terminal of the comparison system 3 is connected to the other output terminal of the bridge 7 by way of the reference source 6 and the resistor 18. The collector of the transistor 14 is connected to the base of the transistor 15. A source 13 of current for the transistors is connected between their emitters and their collectors by way of individual resistors as shown, the positive terminal of the source 13 being connected to the emitters. The collector of the transistor 15 and the common emitter connection constitute the output connections of the comparison system 3. When the voltage $Vm$ is less than the voltage $Vz$, positive voltage from reference source 6 is applied to the base of the transistor 14 in a direction to block it. When the transistor 14 is blocked, negative current flows into the base of the transistor 15 and it becomes fully conductive. When the voltage $Vm$ is greater than the voltage $Vz$, current IB flows out of the base of the transistor 14, see FIGS. 3 and 4, and the transistor 14 becomes conductive and the transistor 15 becomes non-conductive. As shown in FIGS. 3 and 4 the conductivity of transistor 14, and therefore the non-conductivity of transistor 15 continues, while $Vm$ is greater than $Vz$, and when $Vm$ becomes greater, such as $V'm$, the conductivity of transistor 14 and therefore the non-conductivity of transistor 15 continues for a longer period.

Figure 5:
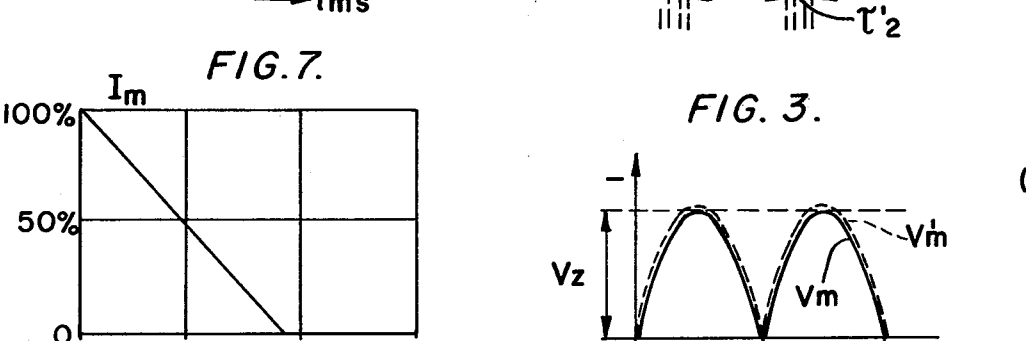

The element 4 is the current interrupter. It comprises a vacuum tube 16 whose anode is connected to one end of the control winding of the transductor 1. The cathode of the tube 16 is connected to the negative terminal of a source 5. The positive terminal of the source 5 is connected to the other terminal of the control winding of the transductor 1. A voltage limiting resistor 17 is connected between the anode and the grid of the tube 16. The grid and the cathode of the tube 16, which constitute the input of the interrupter 4, are connected respectively to the collector and the emitter of the transistor 15, which comprise the output of the comparison system 3. When the transistor 15 is conducting, the potential applied to the grid of the tube 16 is such as to make it conducting as well. When the transistor 15 is non-conducting, the negative potential of the source 13 is applied to the grid of the tube 16 to shut it off. As shown in FIGS. 1 and 5, negative potential $Vs$ is applied to the grid of the tube 16 for the short time that the transistor 14 is conductive and the transistor 15 is non-conductive.

Figure 6:
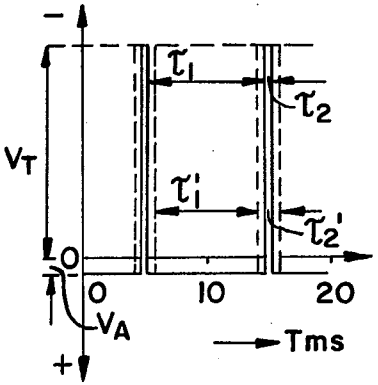
Figure 7:
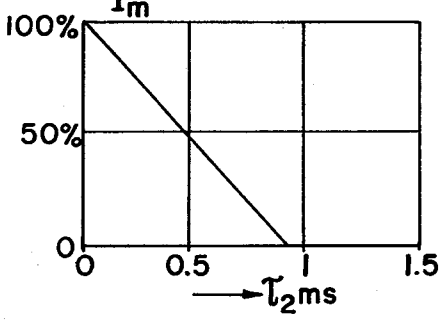

Normally, the voltage across the output terminals $Wy$ is such that the voltage $Vm$, at its peak, is just greater than the reference voltage $Vz$, see FIG. 3. Then for a short period of time $Tau2$, see FIGS. 3 and 4, the transistor 14 has base current IB, see FIG. 4, and transistor 14 is conductive, and transistor 15 is non-conductive, and as stated above the negative voltage of the source 13 is applied to the grid of the tube 16 to render it non-conductive very suddenly. As shown in FIG. 7, the magnetization current $Im$ for the control winding of the transductor 1 reduces from its 100% value to zero in about 0.9 mseconds. A voltage $Vt$, see FIGS. 1 and 6, is induced in the control winding that may be 10 times the voltage of the source 5. Due to this high voltage that is induced in this control winding, the current flow is reduced very quickly, and the reactance of the transductor is changed very quickly. Due to the connection of the transductor 1 to the auto-transformer 11, the voltage of the auto-transformer 11 is changed very quickly in a direction to keep the voltage across the output terminals Wy constant.

The current flow in the control circuit of the control winding of the transductor is interrupted as long as the voltage $Vm$ exceeds the voltage $Vz$. Again referring to FIGS. 3 and 4, if the voltage $Vm$ increases to $V'm$ due to the voltage across the terminals $Wy$ going too high, the base current for the transistor 14 flows for the period $Tau'2$. As shown in FIG. 5 blocking potential $Vs$ is now produced for the time period $Tau'2$, instead of $Tau2$, and as shown in FIG. 6, the voltage induced across the control winding of the transductor 1 is increased from $Tau2$ to $Tau'2$. In each of FIGS. 3, 4, 5 and 6, $Tau$ 1 indicates the time between base current flowing IB for FIG. 4, between application of blocking potential $Vs$ for FIG. 5 and between the production of voltage $Vt$ in the control winding for FIG. 6. $Tau'1$ indicates the shorter time between these effects when the increased output voltage causes $Vm$ to become greater, to $V'm$ for example. It is noted that the high voltage $Vt$ is produced for each half cycle of the output alternating current at the terminals $Wy$. Control, from the moment of voltage change at the output terminals $Wy$ up to the occurrence of the interruption of current flow through the control winding of the transductor 1, and the production of the overvoltage $Vt$ in the control winding takes place in a time period so small that it is measured in microseconds. Change in the resistance of the temperature variable resistor 8 takes place more gradually, which results in gradual increase of the unbalance of the bridge 7, greatly improving the sensitivity of the regulator since the energy of the impulses $Vp$ give rise to a quicker control of the output voltage at $Wy$ for higher energy wave causing a longer duration of the overvoltage Vt.

While a preferred embodiment of the invention is illustrated and described, the invention is to be limited only by the terms of the claims and not by the description and showing of the preferred embodiment.

What is claimed is:

1. An alternating current voltage regulator comprising a pair of input terminals to which an alternating voltage is to be applied, a pair of output terminals to which a load may be connected, an auto-transformer having a tap, a transductor having a main winding, a control winding and a saturable core, means for causing a current to flow through said control winding, a connection from one input terminal to said tap on said auto-transformer, a connection from the other input terminal to an end terminal of said auto-transformer by way of said main winding of said transductor, a connection from one output terminal to the other end terminal of said auto-transformer, a connection between said other input terminal to said other output terminal, a source of reference voltage, means for comparing the voltage across said output terminals with said reference voltage, and means responsive to said comparison means for interrupting the flow of current through said control winding.

2. The invention as expressed in claim 1 in which said means for comparing voltages includes a full wave rectifier.

3. The invention as expressed in claim 2 in which said full wave rectifier is unfiltered.

4. The invention as expressed in claim 1 in which said means for comparing voltages includes a resistance bridge having a temperature variable resistance in one arm thereof.

5. The invention as expressed in claim 2 in which said means for comparing voltages includes a resistance bridge having a temperature variable resistance in one arm thereof.

6. The invention as expressed in claim 5 in which said resistance bridge is inserted between said full wave rectifier and said interruption means.

7. The invention as expressed in claim 1 in which said means to cause current to flow through said control winding includes a current source and an interruption element connected in series across said control winding, and said means for interrupting includes means to open circuit said interruption element.

8. An alternating current voltage regulator comprising a pair of input terminals to which an alternating voltage is to be applied, a pair of output terminals to which a load may be connected, an autotransformer having an input connection, an output connection and a common connection, said input connection being connected to one of said input terminals said output connection being connected to one of said output terminals, a transductor having a main winding, a control winding and a saturable core, means for connecting one end of the said main winding of said transductor to the other of said input terminals and the other of said output terminals and further means for connecting the other end of the said main winding of said transductor to said common connection so as to control the voltage appearing at said output terminals, means to cause current to flow through said control winding, a source of reference voltage, means for comparing the voltage across said output terminals with said reference voltage, and means responsive to said comparison means for suddenly interrupting the flow of current through said control winding upon the occurrence of a voltage in said comparison means that is greater than said reference voltage.

9. The invention as expressed in claim 8 in which said means for comparing includes a full wave, unfiltered, rectifier, whereby each half cycle of the voltage across said output terminals is compared with said reference voltage.

10. The invention as expressed in claim 9 wherein a resistance bridge one of whose arms is a temperature variable resistor is provided following said rectifier in said voltage comparison means.

11. The invention as expressed in claim 8 wherein a resistor bridge one of whose arms includes a temperature variable bridge is included in said comparison means.

* * * * *